US010408540B2

(12) United States Patent
OFallon et al.

(10) Patent No.: US 10,408,540 B2
(45) Date of Patent: Sep. 10, 2019

(54) LAUNDER ASSEMBLY

(71) Applicant: Fives North American Combustion, Inc., Cleveland, OH (US)

(72) Inventors: Theresa Marie OFallon, Trussville, AL (US); Scott Evans Roach, Birmingham, AL (US)

(73) Assignee: Fives North American Combustion, Inc., Cleveland, OH (US)

( * ) Notice: Subject to any disclaimer, the term of this patent is extended or adjusted under 35 U.S.C. 154(b) by 176 days.

(21) Appl. No.: 15/385,970

(22) Filed: Dec. 21, 2016

(65) Prior Publication Data

US 2018/0172351 A1 Jun. 21, 2018

(51) Int. Cl.
*F27D 3/14* (2006.01)
*B22D 45/00* (2006.01)

(52) U.S. Cl.
CPC ..... *F27D 3/145* (2013.01); *B22D 45/00* (2013.01)

(58) Field of Classification Search
CPC ..... B22D 55/04; B22D 45/00; B22D 41/01; B22D 41/02; F27D 3/145; F27D 1/0006
USPC ..... 222/591, 593; 266/236; 164/335, 437, 164/455, 155.1
See application file for complete search history.

(56) References Cited

U.S. PATENT DOCUMENTS

| | | | | |
|---|---|---|---|---|
| 4,526,351 | A | 7/1985 | Labate | |
| 6,973,955 | B2 * | 12/2005 | Tingey | B22D 35/06 164/133 |
| 7,033,538 | B2 * | 4/2006 | Eckert | F27D 3/145 266/196 |
| 8,657,164 | B2 | 2/2014 | Reeves et al. | |
| 8,883,070 | B2 | 11/2014 | Reeves et al. | |
| 9,248,497 | B2 | 2/2016 | Vincent | |
| 9,375,784 | B2 | 6/2016 | Boorman et al. | |
| 2008/0163999 | A1 | 7/2008 | Hymas et al. | |
| 2016/0138868 | A1 | 5/2016 | Bosworth et al. | |

FOREIGN PATENT DOCUMENTS

| | | |
|---|---|---|
| CN | 104422287 | 3/2015 |
| CN | 104985167 | 10/2015 |
| GB | 2517235 | 4/2014 |
| JP | 52145341 | 12/1977 |
| JP | 2000130959 | 5/2000 |

* cited by examiner

*Primary Examiner* — Scott R Kastler
*Assistant Examiner* — Michael Aboagye
(74) *Attorney, Agent, or Firm* — Benesch, Friedlander, Coplan & Aronoff LLP

(57) ABSTRACT

An apparatus for use with a launder shell includes a heating component formed of refractory material. The heating component has a compartment configured to contain an electrical heating element. The apparatus further includes an elongated trough section configured for placement in an installed position inside the shell. The trough section has a fluid flow channel and a cavity beneath the channel. The cavity is configured to receive and support the heating component for movement into and out of the installed position together with the trough section.

6 Claims, 4 Drawing Sheets

LAUNDER ASSEMBLY

TECHNICAL FIELD

This technology includes an apparatus for conveying molten metal from a furnace to a mold.

BACKGROUND

A particular type of trough has a channel for directing a stream of molten metal to flow from a furnace to a mold. Such a trough, which is known as a launder, is typically formed in sections that are connected end-to-end. The launder may have a cover over the channel, and may include heaters for maintaining the metal in the liquid state fully along the flow path from the furnace to the mold.

SUMMARY

An apparatus for use with a launder shell includes a heating component. The heating component is formed of refractory material, and has a compartment configured to contain an electrical heating element. The apparatus further includes an elongated trough section configured for placement in an installed position inside the shell. The trough section has a fluid flow channel and a cavity beneath the channel. The cavity is configured to receive and support the heating component for movement into and out of the installed position together with the trough section.

Summarized differently, an apparatus includes an elongated trough section configured for placement in an installed position inside a launder shell. The trough section has a fluid flow channel, and has a convex refractory surface facing downward beneath the channel. The apparatus further includes a heating component with a compartment configured to contain an electrical heating element. The heating element component has a concave refractory surface configured to face upward toward the convex refractory surface of the trough section.

DETAILED DESCRIPTION

Figure 1:
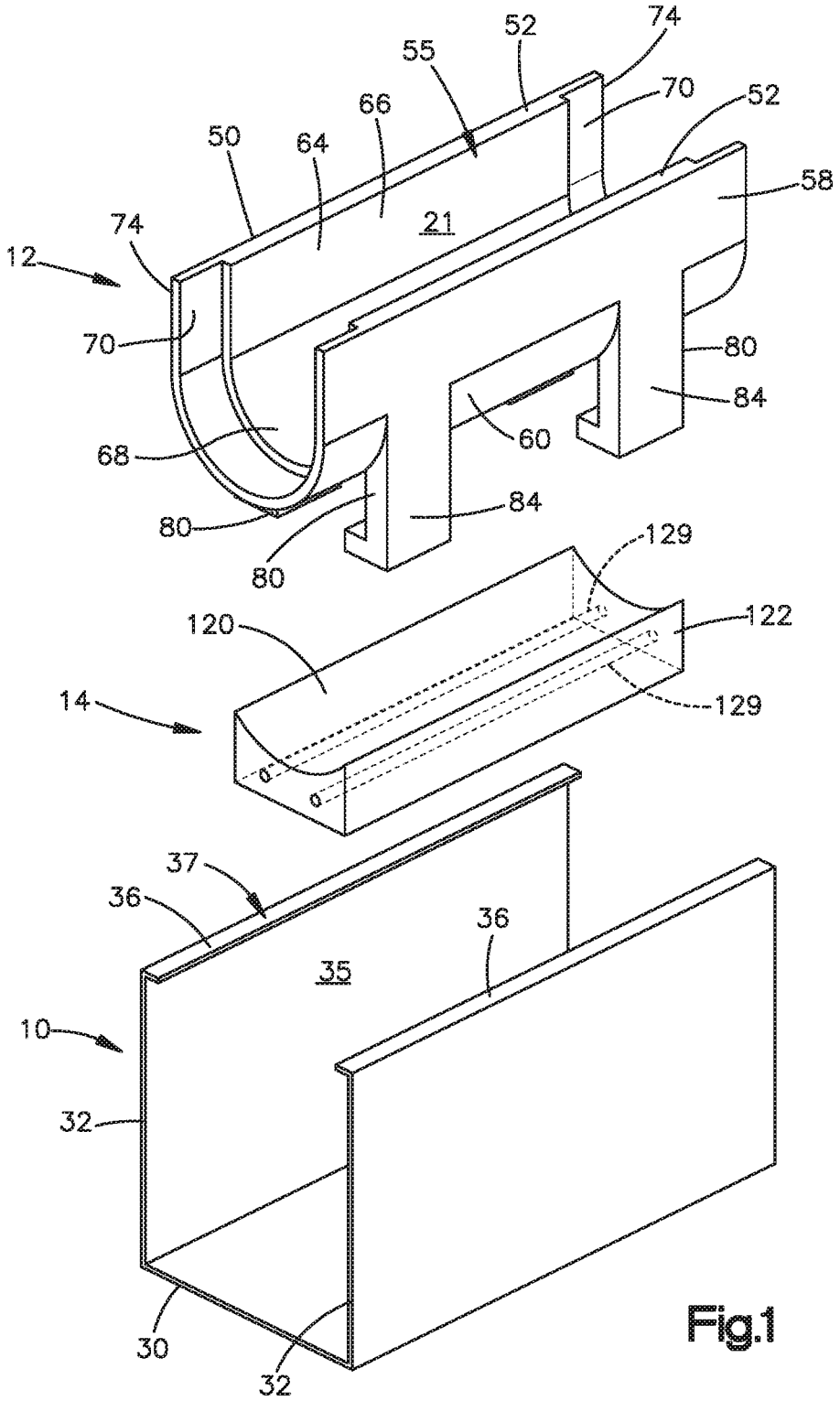
FIG. 1 is an exploded perspective view of parts of a launder section, taken from above.

The structures illustrated in the drawings include examples of the elements recited in the claims. The illustrated structures thus include examples of how a person of ordinary skill in the art can make and use the claimed invention. These examples are described to meet the enablement and best mode requirements of the patent statute without imposing limitations that are not recited in the claims. One or more of the elements of one embodiment may be used in combination with, or as a substitute for, one or more elements of another as needed for any particular implementation of the invention.

Figure 2:
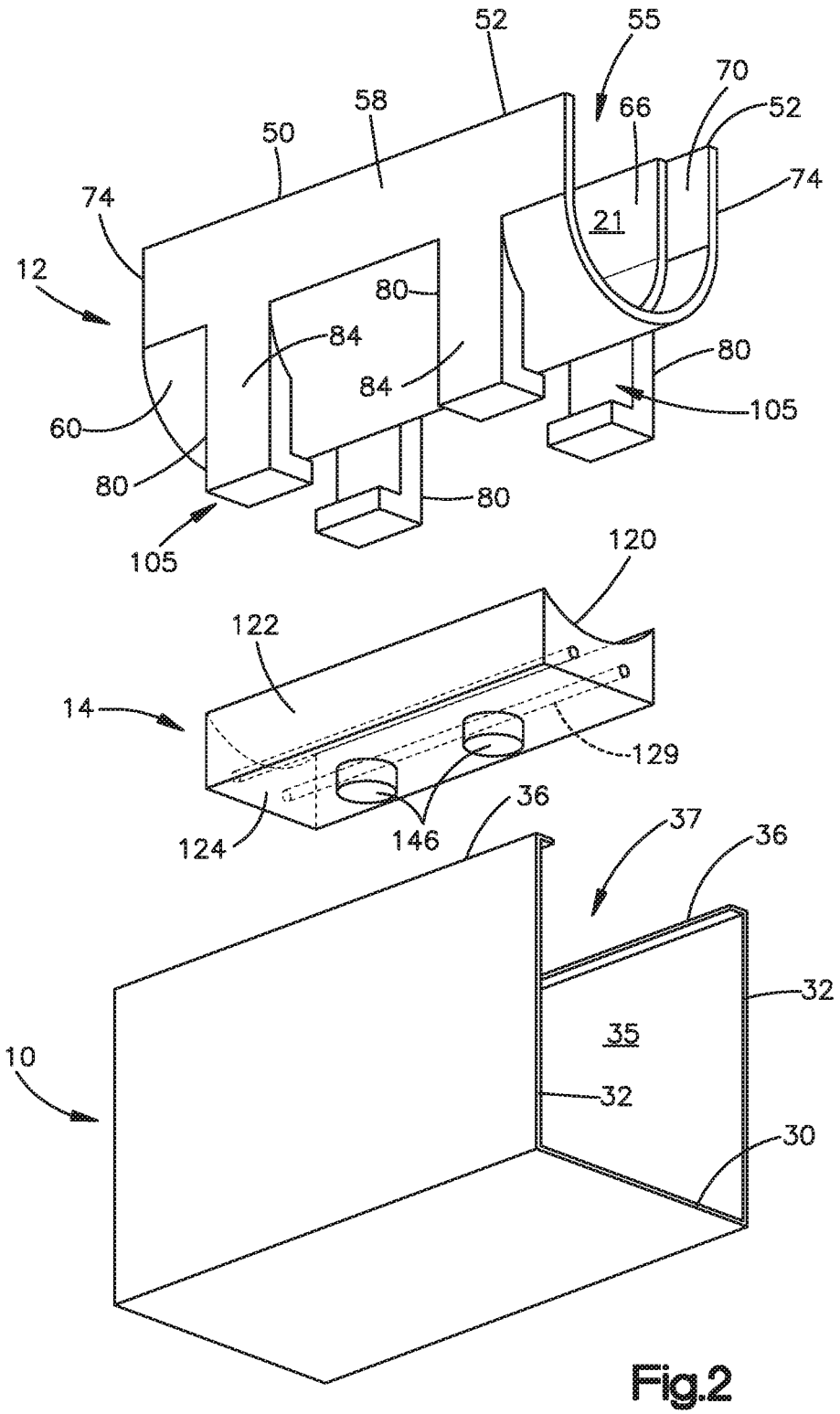
FIG. 2 is a view similar to FIG. 1, taken from beneath.

Parts of an individual launder section are shown in FIGS. 1 and 2. These include a shell 10, a trough insert 12, and a heater body 14. The shell 10 defines the length of the individual launder section among others are that joined end-to-end. The trough insert 12 has a channel 21 that likewise serves as section of a longer channel reaching throughout the length of the launder. The heater body 14 and the trough insert 12 are configured for interconnection separately from the shell 10, and for placement in the shell 10 together as a modular unit.

The shell 10 is three-sided metal structure with a bottom wall 30 and a pair of opposite side walls 32 defining an elongated rectangular interior 35. Upper corners 36 of the side walls 32 are level with one another at the open top 37 of the shell 10. A launder cover (not shown) may be configured to fit over the open top 37, as known in the art.

The trough insert 12 is formed of refractory material, and has an elongated body 50 with a U-shaped lateral cross-section. Upper edges 52 of the body 50 are level with one another at the open top 55 of the channel 21. An outer surface of the body 50 has planar side portions 58 reaching downward from the upper edges 52. A convex bottom portion 60 of the outer surface reaches transversely between the side portions 58.

A major inner surface 64 of the body 50 has planar side portions 66 and a concave bottom portion 68. Those surface portions 66 and 68 together define the width and depth of the channel 21. The length of the channel 21 extends further over a pair of minor inner surfaces 70 that reach from the major inner surface 64 to the opposite ends 74 of the body 50. The minor inner surfaces 70 are recessed from the major inner surface 64 to receive couplers (not shown) that interconnect this trough insert 12 with adjacent trough inserts 12 reaching lengthwise of the launder.

The trough insert 12 also has legs 80 projecting downward from the body 50. In this embodiment the legs 80 are alike, and are arranged in two pairs. The legs 80 in each pair are located on laterally opposite sides of the body 50. The two pairs of legs 80 are spaced apart along the length of the body 50, and are evenly spaced longitudinally inward from the opposite ends 74.

Figure 3:
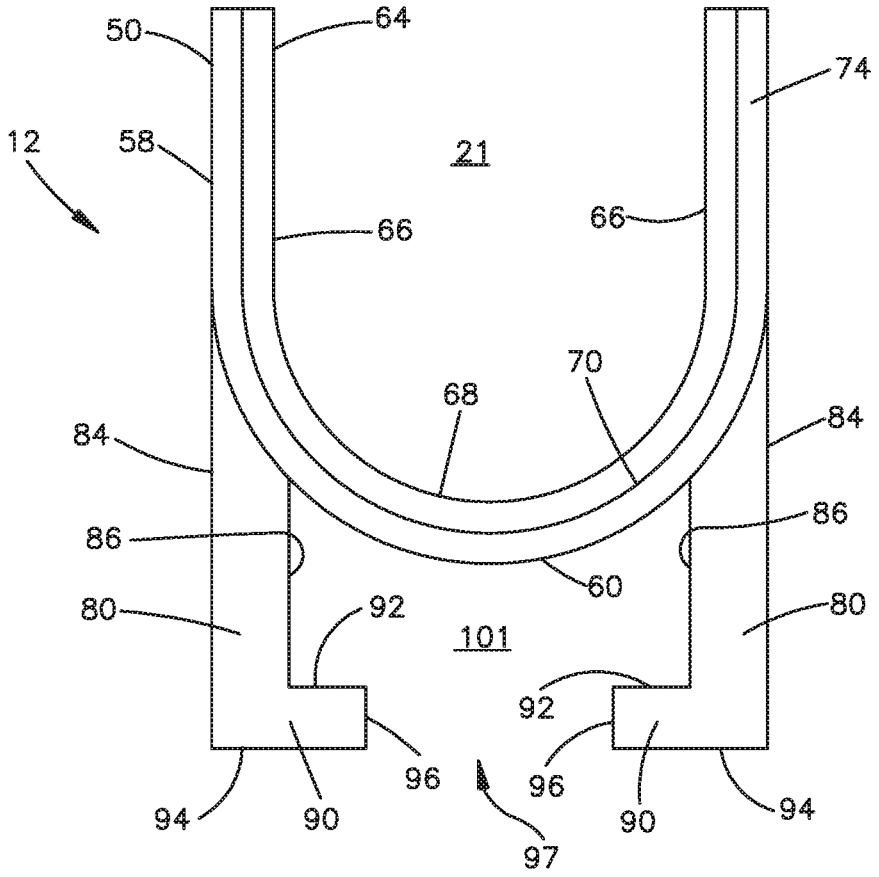
FIG. 3 is an end view of a part shown in FIGS. 1 and 2.

Each leg 80 has a vertical outer surface 84 that is coplanar with the adjacent outer side surface 58 of the body 50. As best shown in FIG. 3, each leg 80 also has a planar vertical inner surface 86 projecting downward from the bottom surface 60 of the body 50. The vertical inner surfaces 86 at each pair of legs 80 face one another oppositely across and beneath the body 50.

Foot portions 90 of the legs 80 have co-planar, horizontal inner surfaces 92 projecting laterally inward from the vertical inner surfaces 86. The foot portions 90 further have a co-planar, horizontal outer surfaces 94 defining the bottoms of the legs 80. Planar vertical surfaces 96 of the foot portions 90 are opposed across gaps 97 between the legs 80.

As thus shown in FIG. 3, the legs 80 together define an elongated cavity 101 beneath the body 50 of the trough insert 12. The width of the cavity 101 reaches transversely between the opposed vertical surfaces 86. The height of the cavity 101 reaches from the horizontal inner surfaces 92 to the convex bottom surface 60. As best shown in FIG. 2, the cavity 101 has an open end 105 at each pair 82 of legs 80. The cavity 101 is also open along and across the bottom of the tough insert 12 between the legs 80.

Like the trough insert 12, the heater body 14 is formed of refractory material. However, unlike the trough insert 12, the heater body 14 is not configured for end-to-end connection with similar sectional parts of the launder. Instead, the heater body 14 is configured as one of multiple separate heater bodies 14, each of which cooperates with a respective trough insert 12 independently of the other heater bodies 14.

Figure 4:
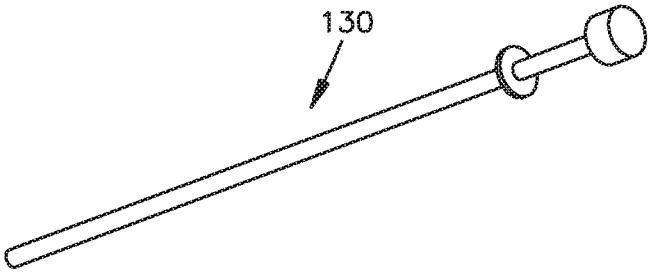
FIG. 4 is a view of another part of the launder section.

As shown in FIGS. 1 and 2, the heater body 14 is shaped as a rectangular block with a length equal or approximately equal to the length of the cavity 101 in the trough insert 12. A top surface 120 of the heater body 14 has a concave contour matching the convex contour at the bottom surface 60 of the trough insert 12. Opposite side surfaces 122 are planar and vertical. A bottom surface 124 is planar and horizontal. Bores 129 reaching longitudinally through the heater body 14 are configured to receive electrical heating elements. An example of one such heating element 130 is shown schematically in FIG. 4.

Figure 5:
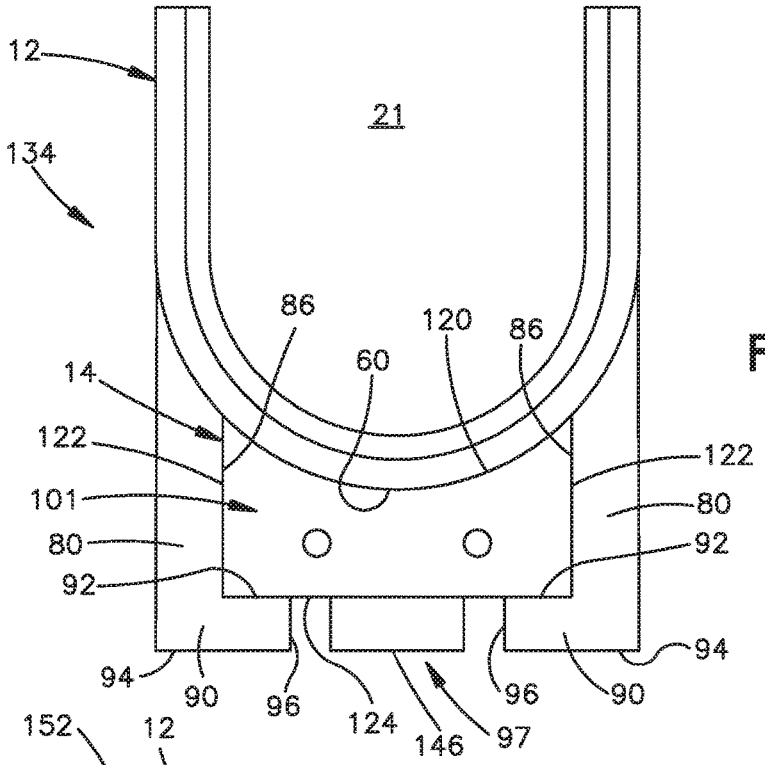
FIG. 5 is a partly sectional view showing parts of the launder section in an interconnected relationship.

Either before or after the heating elements 130 are operatively installed in the bores 129, the heater body 14 is installed in the cavity 101 as shown in FIG. 5. This is accomplished by sliding the heater body 14 lengthwise through an open end 105 of the cavity 101. The vertical opposite side surfaces 122 of the heater body 14 then slide against the opposed vertical inner surfaces 86 in the cavity 101. The horizontal bottom surface 124 of the heater body 14 slides against the horizontal inner surfaces 92 in the cavity 101. The concave top surface 120 of the heater body 14 slides against the convex bottom surface 60 in the cavity 101. The legs 80 then serve as brackets that hold the heater body 14 closely but removably within the cavity 101. Preferably, the heater body 14 does not project longitudinally from the cavity 101 to either end 74 of the trough insert 12, and is thus spaced from the joints where molten metal might leak from the channel 21. Additionally, the heater body 14 and the trough insert 12 adjoin at the surfaces 120 and 60 directly beneath the channel 21 for optimal heat transfer from the heating elements 130 to the channel 21.

Figure 6:
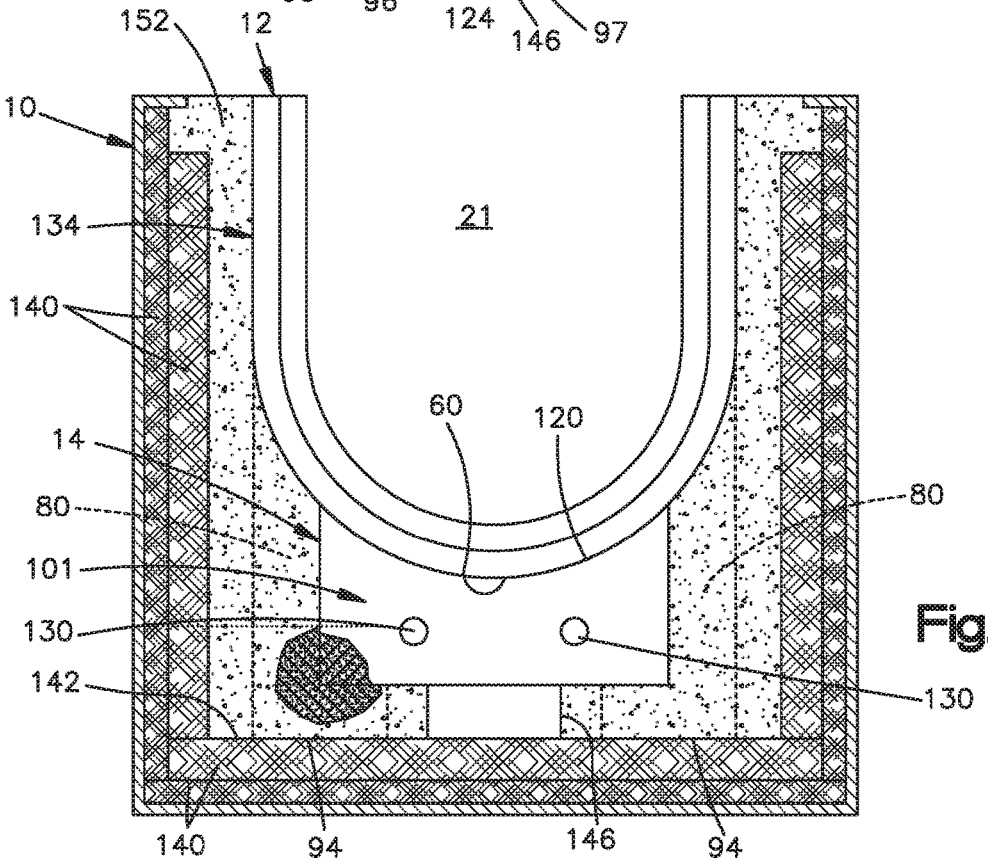
FIG. 6 is a view similar to FIG. 5, showing additional parts of the launder section.

When the heater body 14 and the trough insert 12 are interconnected as shown in FIG. 5, they are moveable into and out of the shell interior 35 together as a modular unit 134. This facilitates installation of those parts 12 and 14 in an installed position within the shell 10, as shown for example in FIG. 6. In this embodiment, rigid layers 140 of high performance thermal insulation are first placed against the walls 30 and 32 of the shell 10. The bottoms 94 of the legs 80 are placed on a horizontal upper surface 142 of one such insulating layer 140. Vertical projections 146 at the bottom of the heater body 14 also adjoin the upper surface 142 of the insulating layer 140, and are sized to ensure adjoining contact at the convex/concave surfaces 60 and 120. More specifically, the legs 86 and the projections 146 have heights that are predetermined with reference to one another so that the heater body 14 and the trough insert 12 adjoin at the surfaces 120 and 60 directly beneath the channel 21 when the modular unit 134 rests on the upper surface 142 of the insulating layer 140. The space between the modular unit 134 and the insulation layers 140 is then backfilled with a dry vibratable insulating powder material 152.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

The invention claimed is:

1. An apparatus for use with a launder shell and an electrical heating element, the apparatus comprising: a heating component formed of refractory material and having a compartment configured to contain the heating element; and an elongated trough component configured for placement in an installed position inside the shell, the trough component having refractory surfaces defining a fluid flow channel, and further having opposed bracket portions that are located beneath the channel and configured to receive and support the heating component between the bracket portions, whereby the trough component and the heating component are movable into and out of the installed position inside the shell together as interconnected parts of a modular unit.

2. An apparatus as defined in claim 1, wherein the bracket portions of the trough component together define a cavity having an open end located at an end of the trough section, and the open end of the cavity is configured for insertion of the heating component longitudinally through the open end.

3. An apparatus as defined in claim 2, wherein the bracket portions of the trough component have inner surfaces facing laterally across the cavity, and the heating component is configured to slide along the inner surfaces upon insertion in the cavity.

4. An apparatus as defined in claim 1 further comprising a layer of insulating material configured for placement inside the shell, wherein the bracket portions of the trough component are configured to support the trough component on an upper surface of the layer of insulating material when the trough component is in installed position inside the shell.

5. An apparatus as defined in claim 1, wherein the trough component has a convex refractory surface facing downward into the cavity, and the heating component has a concave refractory surface configured to face upward toward the convex refractory surface of the trough component.

6. An apparatus as defined in claim 5, wherein the concave refractory surface of the heating component is configured to adjoin the trough component in contact with the convex refractory surface of the trough component.

* * * * *